US012703901B2

(12) United States Patent
Castan et al.

(10) Patent No.: US 12,703,901 B2
(45) Date of Patent: Aug. 11, 2026

(54) STEEL AEROSOL MONOBLOC

(71) Applicant: ArcelorMittal, Luxembourg (LU)

(72) Inventors: Christophe Castan, Hettange Grande (FR); Michel D'Amore, Tressange (FR); Gilles Mangin, Metz (FR); Laura Rigoni Medeiros, Thionville (FR)

(73) Assignee: ArcelorMittal, Luxembourg (LU)

( * ) Notice: Subject to any disclaimer, the term of this patent is extended or adjusted under 35 U.S.C. 154(b) by 578 days.

(21) Appl. No.: 18/267,000

(22) PCT Filed: Dec. 9, 2021

(86) PCT No.: PCT/IB2021/061481

§ 371 (c)(1),
(2) Date: Jun. 13, 2023

(87) PCT Pub. No.: WO2022/130131

PCT Pub. Date: Jun. 23, 2022

(65) Prior Publication Data

US 2024/0060160 A1 Feb. 22, 2024

(30) Foreign Application Priority Data

Dec. 16, 2020 (WO) ..... PCT/IB2020/062005

(51) Int. Cl.

| | |
|---|---|
| ***C22C 38/04*** | (2006.01) |
| ***C21D 8/04*** | (2026.01) |
| ***C21D 9/46*** | (2006.01) |
| ***C22C 38/00*** | (2006.01) |
| ***C22C 38/02*** | (2006.01) |
| ***C22C 38/06*** | (2006.01) |

(52) U.S. Cl.

CPC ..... *C22C 38/04* (2013.01); *C21D 8/04* (2013.01); *C21D 8/0426* (2013.01); *C21D 8/0436* (2013.01); *C21D 8/0473* (2013.01); *C21D 8/0478* (2013.01); *C21D 9/46* (2013.01); *C22C 38/002* (2013.01); *C22C 38/02* (2013.01); *C22C 38/06* (2013.01); *C21D 2211/005* (2013.01)

(58) Field of Classification Search

None

See application file for complete search history.

(56) References Cited

FOREIGN PATENT DOCUMENTS

| | | | |
|---|---|---|---|
| EP | 2634282 | A1 | 9/2013 |
| EP | 2 098312 | B1 | 2/2017 |
| JP | H0641681 | A | 2/1994 |
| JP | H09194993 | A * | 7/1997 |

OTHER PUBLICATIONS

Search Report of PCT/IB2021/061481 of Feb. 25, 2022 and International Report on Patentability.

* cited by examiner

*Primary Examiner* — Anthony M Liang
(74) *Attorney, Agent, or Firm* — Davidson Kappel LLC

(57) ABSTRACT

A tin coated steel sheet is provided for manufacturing a drawn can having: a thickness inferior to 0.7 mm, a yield strength inferior to 400 MPa, an average grain aspect ratio below 1.5, a strain hardening coefficient below 1.5, a tin coating from 0.5 to 4.0 $g \cdot m^{-2}$ on a first face and from 2.8 to 11.2 $g \cdot m^{-2}$ on a second face, a chemical composition comprising in weight percent $0.002 \leq C \leq 0.09$ and $0.0015 \leq B \leq 0.005$ and a balance of Fe and unavoidable impurities, and the steel sheet having a ferritic microstructure with a mean grain size from 5 to 15 μm.

12 Claims, 1 Drawing Sheet

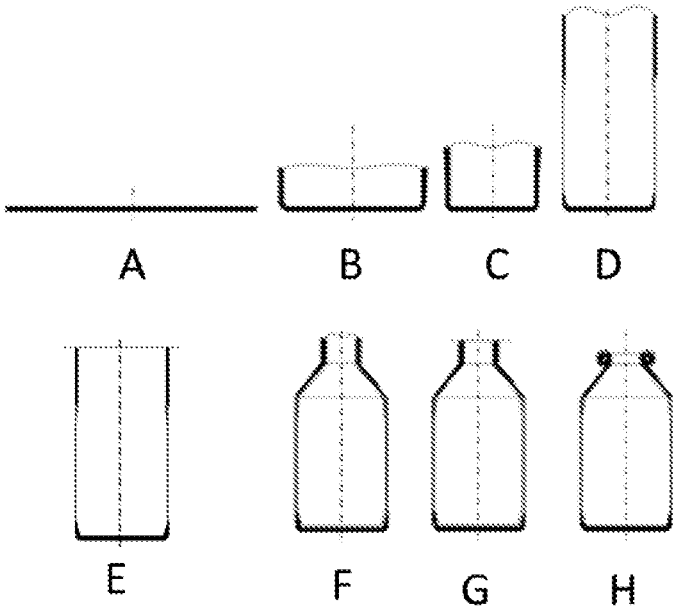
A
B
C
D
E
F
G
H

STEEL AEROSOL MONOBLOC

The present invention relates to a tin coated steel strip for manufacturing a drawn and wall-ironed aerosol can and a method for manufacturing a tin coated steel strip.

BACKGROUND

The aerosol cans can be divided into two categories. The first type, known as the "welded cans", comprise several parts attached one to another by welding or crimping. The welded cans made of steel are usually composed of at least three steel pieces: a bottom, a body and a top. To manufacture such a three pieces aerosol, steel blanks are cut from steel coils and then deformed and curved to form the pieces. Then the bottom and top parts are attached via crimping to the aerosol body. Alternatively, it can be composed of two pieces, for example a drawn body comprising a top, and a crimped bottom.

The second type, known as the "drawn cans", comprise only one block which is deep drawn and also sometimes wall ironed.

Moreover, in some markets, such as the cosmetic one, aerosols comprising only one piece are preferred for aesthetic reasons mainly.

SUMMARY OF THE INVENTION

The process steps for the welded cans and the drawn cans are different and so are the required steel properties. This is particularly true for the forming route which is very demanding for the one-piece aerosols which are drawn and wall ironed. For example, the necking rate in order to shape the top can go up to 75% for a one-piece aerosol whereas it is only up to 25% for a one-piece beverage can body which undergoes a similar forming route. The main forming process steps of the one-piece cans are represented in FIG. and explained hereafter.

Firstly, a steel sheet is cut to form steel blanks (A). The diameter and thickness of said blank depend on the dimensions of the desired aerosol.

Secondly, said steel blanks are press-formed during the drawing (B) and the redrawing (C) to make cups. For the monobloc aerosols, two drawing steps are usually necessary because of a high ratio between the blank diameter and the aerosol diameter.

Thirdly, a wall-ironing step is conducted to elongate the aerosol body (D). In most cases, the wall thickness is not constant along the body height. The "midwall" is generally circa 50 μm thinner than the "topwall" which will then be used to form the neck. Generally, the thickness of the "midwall" is circa 30% of the blank thickness.

Furthermore, the shell extremity is trimmed (E), and the shell is washed and dried. The temperature during the drying step can reach 200° C. and last around five minutes. Consequently, this drying step can provoke an aging of the steel, such as during a bake hardening step.

Then a varnish on the external face is applied and cured and the same operations are done for the internal face (not represented). The varnish is generally an organic coating such as those comprising polyester based or organic lacquers. The curing can also provoke an aging of the steel.

A neck, having a smaller diameter than the body, is formed during the necking (F). Then this neck is trimmed (G). Finally, the top part of the neck is curled, rolled up on itself, in the curling step (H). In those steps, necking and curling, the organic coating is highly stressed damaged due to the mechanical deformation. Consequently, several defects appear during the necking and curling steps such as:

- the appearance of folds on the neck area,
- a degradation of the varnish in the neck and curl area
- the rupture of the steel in the neck or curl area.

Those defects lead to inhomogeneity of the drawn can coating and even to an absence of coating in some areas, especially on the interior face of the neck and curl areas. The higher the necking rate, the more damaged is the coating.

EP 2 098 312 discloses a method for making a monobloc aerosol can using a steel sheet that is coated with an organic film prior to the forming steps, as described previously. Thanks to this coated steel, an aerosol can be formed without buckling or cracking. It is achieved when the steel sheet has a tensile strength between 600 MPa and 800 MPa after forming at an equivalent strain $\varepsilon_{EQ}$ of 1.6 and satisfies 0.25<tb/to where tb is the sheet thickness at a fracture surface after fracture and to is a sheet thickness before fracture. Boron present from 1 to 30 ppm tends to decrease the occurrence of crack when curling is performed at high speed, at a speed of 120 strokes per minute. However, such solution does not address the problem of the degradation of the varnish in the neck and curl area.

A goal of this invention is to provide a steel sheet for manufacturing one-piece aerosol able to preserve the varnish, wherein the varnish is applied after the wall ironing and before the necking step, as well as a method to manufacture such a steel sheet.

The present invention provides a tin coated steel sheet for manufacturing a drawn can having

- a thickness inferior to 0.7 mm,
- a yield strength inferior to 400 MPa,
- an average grain aspect ratio below 1.5,
- a strain hardening coefficient below 1.5,
- a tin coating from 0.5 to 4.0 $g \cdot m^2$ on a first face and from 2.8 to 11.2 $g \cdot m^2$ on a second face,
- a chemical composition of the steel sheet in weight percent comprising: $0.002 \leq C \leq 0.09$; $0.05 \leq Mn \leq 0.6$; $0.0015 \leq B \leq 0.005$; $N \leq 0.05$; $Ni \leq 0.2$; $S \leq 0.03$; $P \leq 0.02$; $Si \leq 0.03$; $Cr \leq 0.2$; $0.01 \leq Al \leq 0.08$; $Cu \leq 0.2$; $Nb \leq 0.05$; $V \leq 0.02$; $Ti \leq 0.05$; and a balance consisting of Fe and unavoidable impurities and said steel sheet having a ferritic microstructure with a mean grain size from 5 to 15 μm.

A method for manufacturing the tin coated steel sheet as described above, said method comprising the following successive steps:

- casting a steel to obtain a slab, said steel having a composition as described above,
- reheating the slab at a temperature $T_{reheat}$ comprised from 1100° C. to 1300° C.,
- hot rolling said slab at a temperature from 1000° C. to 1300° C.
- coiling the resulting hot rolled steel sheet at a coiling temperature of at least 600° C.,
- cold rolling said sheet until a thickness below 0.7 mm is obtained,
- batch annealing said cold rolled sheet with a heating rate from 10 to 50° C. per hour, a soaking temperature from 600 to 700° C. and a soaking time of at least 1 hour,
- temper rolling said annealed sheet at an elongation rate from 0 to 15%,
- tinning.

BRIEF DESCRIPTION OF THE DRAWINGS

Other characteristics and advantages of the invention will become apparent from the following detailed description of the invention.

FIG. 1 illustrates the process steps of a drawn can formation from a steel sheet.

DETAILED DESCRIPTION

The invention relates to a tin coated steel sheet for manufacturing a drawn can having:

- a thickness inferior to 0.7 mm,
- a yield strength inferior to 400 MPa,
- an average grain aspect ratio below 1.5,
- a strain hardening coefficient below 1.5,
- a tin coating from 0.5 to 4.0 $g \cdot m^2$ on a first face and from 2.8 to 11.2 $g \cdot m^2$ on a second face,
- a chemical composition of the steel sheet in weight percent comprising: $0.002 \leq C \leq 0.09$; $0.05 \leq Mn \leq 0.6$; $0.0015 \leq B \leq 0.005$; $N \leq 0.05$; $Ni \leq 0.2$; $S \leq 0.03$; $P \leq 0.02$; $Si \leq 0.03$; $Cr \leq 0.2$; $0.01 \leq Al \leq 0.08$; $Cu \leq 0.2$; $Nb \leq 0.05$; $V \leq 0.02$; $Ti \leq 0.05$; and a balance consisting of Fe and unavoidable impurities and said steel sheet having a ferritic microstructure with a mean grain size from 5 to 15 μm.

The manufacture of one-piece aerosol leads to necking rates from 40 to 60%. The necking rate is equal to: $(D_{BODY}-D_{APERTURE})/(D_{BODY})$, wherein $D_{BODY}$ is the dimeter of the body and $D_{APERTURE}$ is the diameter of the aperture.

The steel sheet comprises from 0.002 to 0.090 weight percent of carbon. If the carbon content exceeds 0.090 weight percent, the yield stress after being temper rolled would exceed 400 MPa and the planar anisotropy would be too high leading to a waste of too much metal during the trimming step. Preferably, the carbon content is of at least 0.02.

The manganese content of the steel strip is from 0.05 to 0.6 weight percent. If the manganese content is above 0.6 weight percent, the steels becomes too hard and negatively affect the formability but if its content is below 0.05 weight percent, surface cracks might form.

The nitrogen content of the steel strip is below 0.05 weight percent. If the nitrogen content exceeds 0.05 weight percent, a too high boron content would be necessary to avoid having nitrogen in solid solution after hot rolling.

The sulphur content of the steel strip is below 0.03 weight percent. If the S content is above, cracks can appear during the curling operation due to a lower local ductility.

The silicon content of the steel strip is below 0.03 weight percent. If it is higher, the renders the hot rolling difficult and the steel becomes too hard.

The aluminium content of the steel strip is from 0.01 weight percent. If the aluminium content exceeds 0.08 weight percent, the risk of having inclusions of alumina in the steel becomes too high.

The boron content of the steel strip is from 0.0015 to 0.005 weight percent. Such a boron content has a positive impact on the homogeneity and the strain hardening coefficient. This boron content permits a decrease of the impact of the coiling temperature on carbide size and an increase of the homogeneous precipitation of boron nitride in the austenite which favour the formation of equiaxed grains after annealing. Furthermore, it lowers the strain hardening coefficient which improves the formability.

The microstructure is 100% ferritic. However, it can comprise precipitates of cementite. It does not comprise martensite, nor bainite, nor austenite.

After being temper rolled at an elongation up to 15%, the yield strength is inferior to 400 MPa, and preferably ranges from 180 to 400 MPa. Preferably, the temper rolling is performed at an elongation rate from 3% to 15%. Such a low value of the yield strength of the steel sheet, permits to generally have a yield strength value inferior to 600 MPa of the top wall of the aerosol being formed after an ironing of 50% and before the necking and curling steps. Such a yield strength permits to reduce the shear-compression stress applied by the tools during the necking and curling steps and thus reduce the wrinkling risk. Consequently, the varnish is preserved, especially in the neck area, and forming issues and defects can be prevented. Such a range also increases the reproducibility of the stresses acting on the coating during the forming and thus of the forming process.

The average grain aspect ratio is below 1.5. It permits to have homogeneous mechanical properties which increases reproducibility of the forming process.

The mean grain size is from 5 to 15 μm. This mean grain size can be considered as a small one. This range permits to lower the deformation roughness which is particularly key in the neck area wherein the deformation is the greatest. It permits preservation of the varnish, especially in the neck area. Preferably, said mean grain size is from 7 to 11 μm. Such a range permits one to increase even more the homogeneity of the mechanical properties and to preserve even better the varnish during the forming steps.

Preferably, said tin coated steel sheet respects the following ratio: $B_{MASS}\%/N_{MASS\ \%}>0.6$, wherein $B_{MASS}$ is the weight percent of boron and $N_{MASS}$ is the weight percent of nitrogen of the steel sheet. Such a content permits to reduce the quantity of nitrogen in solid solution. Even more preferably, said tin coated steel sheet respects the following ratio: $B_{MASS\ \%}/N_{MASS\ \%}>0.8$.

The tin coating is not necessarily the same on both faces of the steel strip. The tin coating is from 0.5 to 4.0 $g \cdot m^{-2}$ on a first face and from 2.8 to 11.2 $g \cdot m^{-2}$ on a second face. The tin coating is preferably not reflown. This first face is intended to be used as the interior face of a drawn can because such a tin content improves the varnish adherence. On the contrary, the second face is intended to be used as an exterior face of a drawn can because such a tin content increases the shine. Preferably, said tin content on said second face is from 4.0 to 11.2 $g \cdot m^{-2}$. The tin coating can be done by electroplating where electrodes are used to attract tin ions onto the steel strip. Usually, each strip side is faced by at least an electrode. The greater the intensity of the electrode, the greater will be the tin content. So, in order to have a difference of tin content between the two strip faces, each strip side should be faced by electrodes having different intensity.

Thanks to the features of the claimed steel, it has been observed that the claimed steel is able to preserve the varnish and ease the forming of one-piece aerosol in the neck and curl area. Moreover, thanks to the homogeneous mechanical properties within the coil and from one coil to another, the reproducibility of the forming process of one-piece aerosol is improved.

The invention also relates to a method for manufacturing the tin coated steel sheet, said method comprising the following successive steps:

- casting a steel to obtain a slab, said steel having the above chemical composition,
- reheating the slab at a temperature $T_{reheat}$ comprised from 1100° C. to 1300° C.,
- hot rolling said slab at a temperature from 1000° C. to 1300° C.
- coiling the resulting hot rolled steel sheet at a coiling temperature of at least 600° C.,
- cold rolling said sheet until a thickness below 0.7 mm is obtained, batch annealing said cold rolled sheet with a heating rate from 10 to 50° C. per hour, a soaking temperature from 600 to 700° C. and a soaking time of at least 1 hour, temper rolling said annealed sheet at an elongation rate from 0 to 15%, tinning.

The steel strip temperature at the end of the hot rolling is above the Ar3 temperature of the steel sheet. Preferably, said steel strip is hot rolled from 1050° C. to 1150° C.

The coiling temperature of at least 600° C. and the claimed boron content favours the formation of a steel sheet having a mean grain size from 5 to 15 μm, e.g. the formation of equiaxed grains, and prevents the precipitation of AlN, before the steel recrystallisation, during the annealing. Indeed, the claimed boron content leads to a homogeneous precipitation of boron nitride in the austenite during the hot rolling while the claimed coiling temperature lead to the precipitation of the residual nitrogen, forming AlN. Avoiding nitrogen in solid solution with the precipitation of boron nitride is preferred than with the precipitation of aluminium nitride because the first precipitates homogeneously while the latter precipitates heterogeneously. Preferably, said steel strip is coiled at a coiling temperature of at least 625° C. Such a coiling temperature permits to ensure that the non-precipitated nitrogen will form AlN during the coiling.

This synergetic effect, of the boron content and of the coiling temperature, is improved with the claimed boron/nitrogen ratio.

Preferably, the soaking time is from 20 to 50 hours. Even more preferably, the soaking time is from 30 to 50 hours.

Preferably, said steel strip is cold at a reduction rate from 80% to 90%. Such a reduction rate favours a good planar anisotropy Δr.

Preferably, said steel strip is tempered rolled at an elongation rate from 3 to 15%.

Preferably, said steel strip is tempered rolled at an elongation rate from 0 to 5%. Such a range reduces the hardening of the steel strip and permits to keep a low yield strength.

Performing the annealing step with a batch annealing permits to manufacture a steel sheet being non-ageing. The batch annealing, contrary to the continuous annealing, lowers the presence of carbon in solid solution. Apparently, the carbon in solid solution precipitates to form cementite.

Performing the annealing step with a batch annealing in combination with the claimed boron content permits manufacture of a steel sheet having a yield strength lower than 400 MPa. This is due to a slight increase of the grain size and to the precipitation of carbide in the matrix instead of the grain boundaries before the temper mill.

Performing the annealing step with a batch annealing in combination with an excess of boron compared to the nitrogen content, permits to suppress or a least lower the presence of nitrogen in solid solution. The following equation permits a determination if the boron is in excess compared to the nitrogen: $B^*=B-(11/14)\,N$, wherein $B^*$ is the quantity of boron in excess (also called free boron), B is the quantity of boron and N the quantity of nitrogen. It is due to the formation of boron nitride.

Consequently, contrary to what is recommended in the state of the art, as in EP 2 098 312 B1 for example, the annealing is done by a batch annealing in the present invention. Indeed, it is believed in the state of the art that the batch annealing, having a low heating rate, is harmful to the varnish preservation and for the homogeneity of the mechanical properties for two reasons because it favours the formation of elongated grains and thus the inhomogeneity of the steel sheet mechanical properties and microstructure and because the nitrogen in solution tends to precipitate and to form AlN before the steel recrystallisation.

The present application also relates to a one-piece aerosol manufactured by drawing, redrawing, wall-ironing, varnishing, necking and curling the tin coated steel strip, wherein said first face is located inside the aerosol and the second face is located outside the aerosol.

Experimental Results

In order to assess the impact of the boron content on the steel sheet properties, two samples (S1 and S2) have been produced. Si is an embodiment of the claimed steel strip while S2 differs from the claimed steel strip because its boron content is outside the claimed range, their compositions are described in the Table 1. During their manufacturing, both samples have been reheated at a temperature of 1100° C., hot-rolled at a temperature above Ar3 and coiled at a temperature of 640° C. Then they have been cold rolled with a thickness reduction ratio of 85%. Then the cold rolled steel strips underwent a batch annealing, wherein they have been heated, with a heating rate of 35° $C.h^{-1}$ to 600° C., then they have been maintained at a temperature from 600° C. to 650° C. for 35 hours and finally cooled with a cooling rate of 15° $C.h^{-1}$. Then they have been temper rolled with an elongation rate of 3% and tinned.

S1 has a thickness of 0.457 mm and S2 has a thickness of 0.459 mm. Si has a tin coating of 3.01 $g{\cdot}m^{-2}$ on a first face and of 4.62 $g{\cdot}m^{-2}$ on a second face while S2 has a tin coating of 2.95 $g{\cdot}m^{-2}$ on a first face and of 4.42 $g{\cdot}m^{-2}$ on a second face. S1 and S2 have a 100 percent ferritic microstructure.

TABLE 1

| | Element (w %) | | | | | | | | | | |
|---|---|---|---|---|---|---|---|---|---|---|---|
| | C | N | Al | Mn | B | P | Cr | Ni | Cu | Ti | Si |
| S1 | 0.035 | 0.0035 | 0.02 | 0.185 | 0.0022 | 0.009 | 0.018 | 0.017 | 0.022 | 0.001 | 0.007 |
| S2 | 0.029 | 0.006 | 0.058 | 0.22 | 0.0003 | 0.01 | 0.039 | 0.019 | 0.021 | 0.0015 | 0.006 |

Then, the yield strength, measured according to the norm ISO6892-1:2016, and the strain hardening coefficient (r) have been measured using a sample according to ISO 20×80. The average grain size measured according to the norm ASTM E112-10, and the average aspect ratio of the grains, which is the grain length divided by the grain height, have also been measured. The results are summed up in Table 2.

TABLE 2

| | yield strength (MPa) | r | grain size (μm) | Aspect ratio |
|---|---|---|---|---|
| S1 | 205 | 1.1 | 8.0 | 1.3 |
| S2 | 226 | 1.7 | 16.1 | 2.0 |

It can clearly be seen that the anisotropy ratio is much lower (around 4 times lower) for Si than for S2 and that the grain size for Si is half the one for S2. Such properties indicate that the steel sheet according to the present invention is much more homogeneous than one not comprising the claimed boron content. Moreover, the strain hardening coefficient is much lower for Si than for S2 which improves the formability of the steel sheet. Furthermore, the grain aspect ratio is much closer to 1 for S1 than for S2 which indicates that even if the annealing is done in a batch annealing, the claimed boron content permits favoring of the formation of equiaxed grains.

What is claimed is:

1. A tin coated steel sheet for manufacturing a drawn can, the tin coated steel sheet comprising:

a steel sheet having a first face and a second face, the steel sheet having a thickness less than 0.7 mm, a yield strength less than 400 MPa, an average grain aspect ratio below 1.5, a strain hardening coefficient below 1.5, and a chemical composition in weight percent comprising: $0.002 \leq C \leq 0.09$; $0.05 \leq Mn \leq 0.6$; $0.0015 \leq B \leq 0.005$; $N \leq 0.05$; $Ni \leq 0.2$; $S \leq 0.03$; $P < 0.02$; $Si \leq 0.03$; $Cr \leq 0.2$; $0.01 \leq Al \leq 0.08$; $Cu \leq 0.2$; $Nb \leq 0.05$; $V \leq 0.02$; $Ti \leq 0.05$, Fe and unavoidable impurities, the steel sheet having a ferritic microstructure with a mean grain size from 5 to 15 μm; and a tin coating from 0.5 to 4.0 g·m−2 on the first face and from 2.8 to 11.2 g·m−2 on the second face.

2. The tin coated steel sheet as recited in claim 1, wherein the mean grain size is from 7 μm to 11 μm.

3. The tin coated steel sheet as recited in claim 1, wherein the tin coated steel sheet respects the following ratio: BMASS %/NMASS %>0.6, wherein BMASS % is the weight percent of boron and NMASS % is the weight percent of nitrogen of the steel sheet.

4. The tin coated steel sheet as recited in claim 1, wherein the tin content on the second face is from 4.0 to 11.2 g·m−2.

5. A method for manufacturing the tin coated steel sheet as recited in claim 1, the method comprising the following successive steps:

casting a steel to obtain a slab, said steel having the chemical composition;

reheating the slab at a temperature Treheat from 1100° C. to 1300° C.;

hot rolling the slab at a temperature from 1000° C. to 1300° C. to define a hot rolled steel sheet;

coiling the hot rolled steel sheet at a coiling temperature of at least 600° C., cold rolling the hot rolled steel sheet until a thickness below 0.7 mm is obtained to define a cold rolled steel sheet;

batch annealing the cold rolled sheet with a heating rate from 10 to 50° C. per hour, a soaking temperature from 600 to 700° C. and a soaking time of at least 1 hour to define an annealed sheet;

temper rolling the annealed sheet at an elongation rate from 0 to 15% to define a temper rolled sheet, and tinning the temper rolled sheet.

6. The method as recited in claim 5, wherein the hot rolling is at a temperature from 1050° C. to 1150° C.

7. The method as recited in claim 5, wherein the coiling temperature is at least 625° C.

8. The method as recited in claim 5, wherein the cold rolling is at a rate from 80% to 90%.

9. The method as recited in claim 5, wherein the elongation rate is from 0 to 5%.

10. The method as recited in claim 5, wherein the elongation rate is from 3 to 15%.

11. A one-piece aerosol can manufactured by drawing, redrawing, wall-ironing, varnishing, necking and curling the tin coated steel strip as recited in claim 1, wherein the first face is located inside the aerosol can and the second face is located outside the aerosol can.

12. The tin coated steel sheet as recited in claim 1, wherein the chemical composition in weight percent consists of $0.002 \leq C \leq 0.09$; $0.05 \leq Mn \leq 0.6$; $0.0015 \leq B \leq 0.005$; $N \leq 0.05$; $Ni \leq 0.2$; $S \leq 0.03$; $P \leq 0.02$; $Si \leq 0.03$; $Cr \leq 0.2$; $0.01 \leq Al \leq 0.08$; $Cu \leq 0.2$; $Nb \leq 0.05$; $V \leq 0.02$; $Ti \leq 0.05$, Fe and unavoidable impurities.

* * * * *